US007201603B1

(12) United States Patent
Finona

(10) Patent No.: US 7,201,603 B1
(45) Date of Patent: Apr. 10, 2007

(54) PIVOTING STRAIN RELIEF WIRE GUIDE

(75) Inventor: Michael Santos Finona, Lake Forrest, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/368,962

(22) Filed: Mar. 6, 2006

(51) Int. Cl.
*H01R 13/56* (2006.01)

(52) U.S. Cl. ..... 439/446; 174/86

(58) Field of Classification Search ..... 439/446, 439/468, 352; 174/21 JR, 86
See application file for complete search history.

(56) References Cited

U.S. PATENT DOCUMENTS

| | | | | |
|---|---|---|---|---|
| 1,778,549 | A | 10/1930 | Conner | |
| 1,817,004 | A | 8/1931 | Hubbell, Jr. | |
| 1,961,013 | A | 5/1934 | Saraceno | |
| 2,530,540 | A | 11/1950 | Reichold et al. | |
| 2,540,575 | A | 2/1951 | Finizie | |
| 3,366,788 | A * | 1/1968 | Lantery | 174/86 |
| 3,573,714 | A | 4/1971 | Turner | |
| 4,863,396 | A | 9/1989 | Johnson | |
| 4,959,021 | A * | 9/1990 | Byrne | 439/310 |
| 5,288,242 | A * | 2/1994 | Muzslay | 439/349 |
| 5,380,219 | A * | 1/1995 | Klier | 439/446 |
| 5,390,433 | A * | 2/1995 | Brady | 38/79 |
| 5,735,707 | A * | 4/1998 | O'Groske et al. | 439/446 |
| 6,027,352 | A | 2/2000 | Byrne | |
| 6,105,687 | A | 8/2000 | Hansson | |
| 6,152,639 | A * | 11/2000 | Hsu | 403/116 |
| 6,220,888 | B1 * | 4/2001 | Correa | 439/445 |
| 6,338,645 | B1 | 1/2002 | Tan et al. | |
| 6,406,314 | B1 | 6/2002 | Byrne | |
| 6,478,619 | B1 * | 11/2002 | Wiechmann | 439/587 |
| 6,533,472 | B1 * | 3/2003 | Dinh et al. | 385/95 |
| 6,644,999 | B1 | 11/2003 | Tan et al. | |
| 6,695,620 | B1 * | 2/2004 | Huang | 439/11 |
| 6,838,612 | B2 * | 1/2005 | Krug | 174/21 JR |
| 6,840,795 | B1 * | 1/2005 | Takeda et al. | 439/492 |
| 7,131,858 | B1 * | 11/2006 | Zerebilov | 439/446 |

* cited by examiner

*Primary Examiner*—Tulsidas C. Patel
*Assistant Examiner*—Phuongchi Nguyen
(74) *Attorney, Agent, or Firm*—Peter Van Winkle

(57) ABSTRACT

A wire guide includes first and second tubes (14, 16) having first and second perpendicular axes (22, 26), with the second tube having a backshell (40) that is pivotable about the first axis on the first tube rear end, so wires (30) can be routed in a variety of directions. The first tube rear end and the backshell are pivotally connected by a pair of balls (34, 36) that each lies in a groove (44) in the first tube rear end and in a hole (50) in the backshell portion. A strain relief member lying largely in the first tube rear portion has a through hole (82) extending along the first axis, an outside that forms a 360° groove (84), and at least one end slot (90, 92) that connects the hole to the groove. A wire (30) can extend through much of the hole, then through a slot to the groove and around the groove, and then back through a slot.

14 Claims, 3 Drawing Sheets

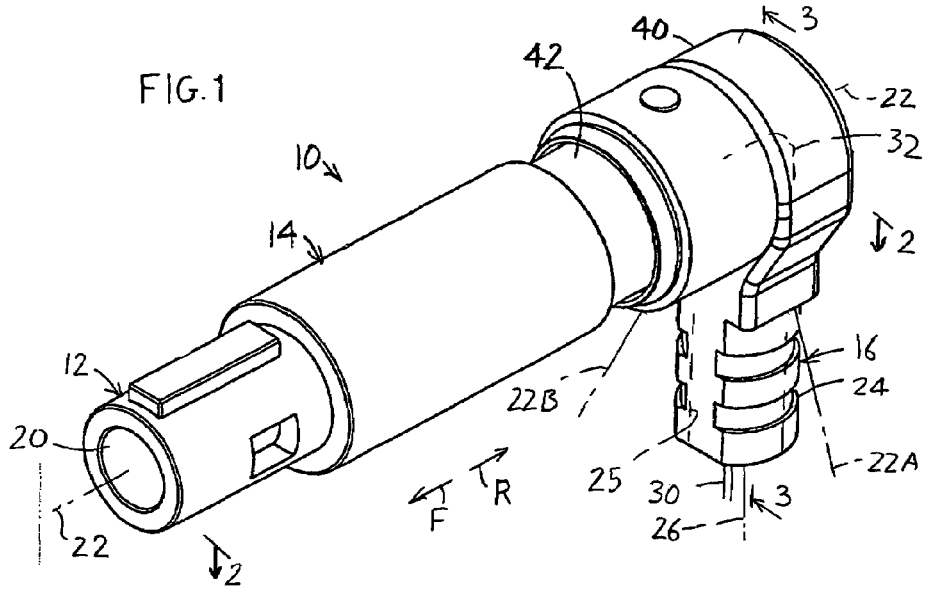
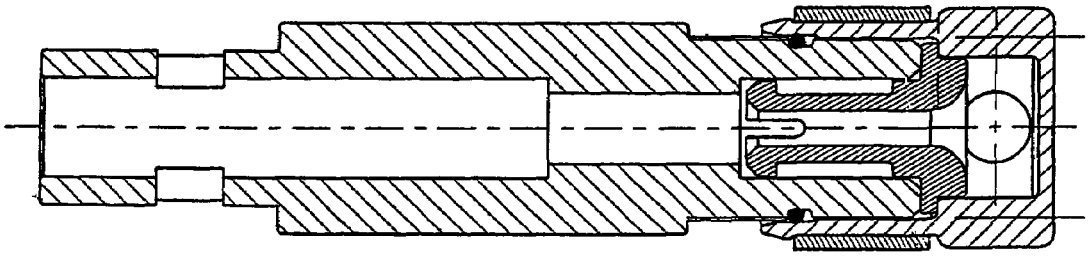
FIG. 2
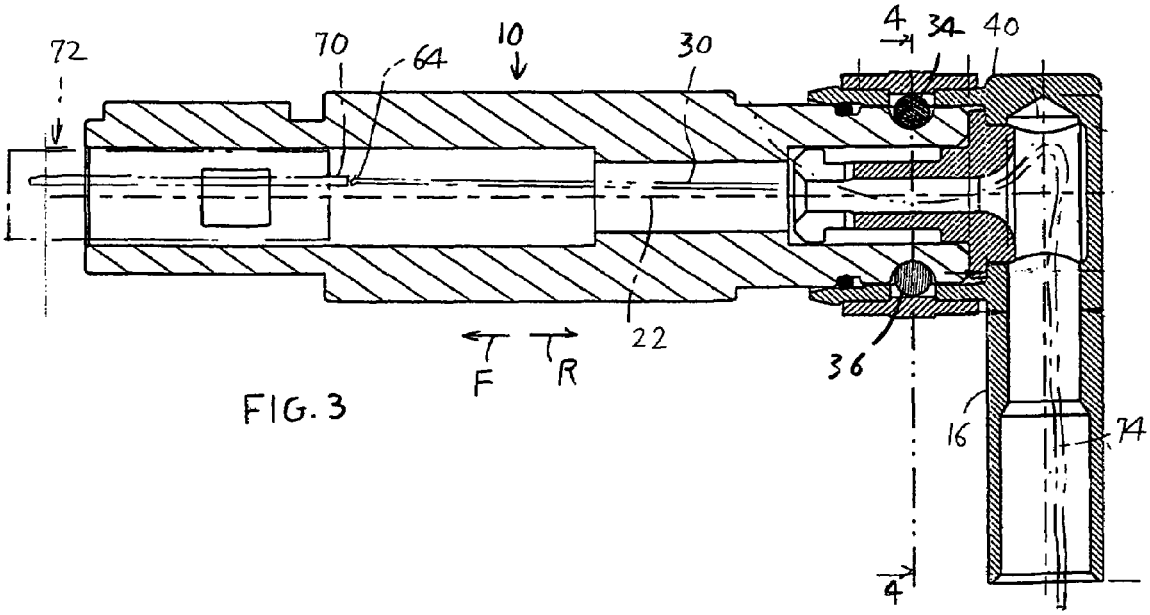
FIG. 3

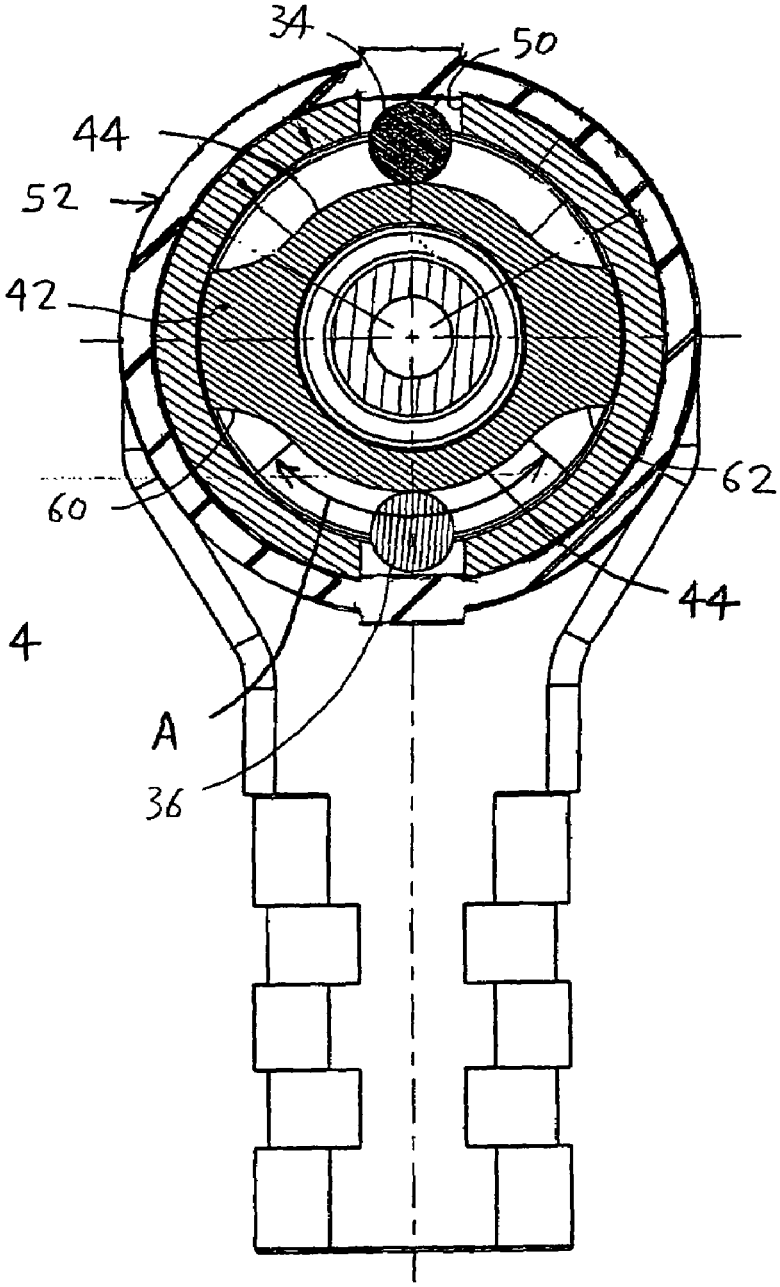
FIG. 4
FIG. 5
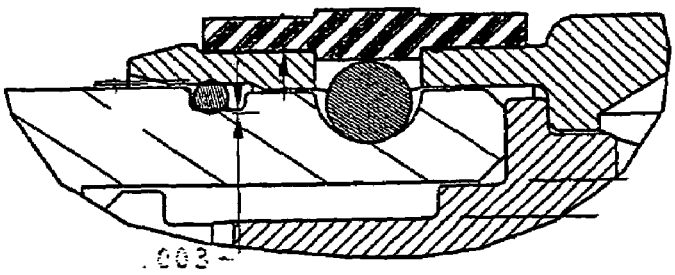

FIG. 6
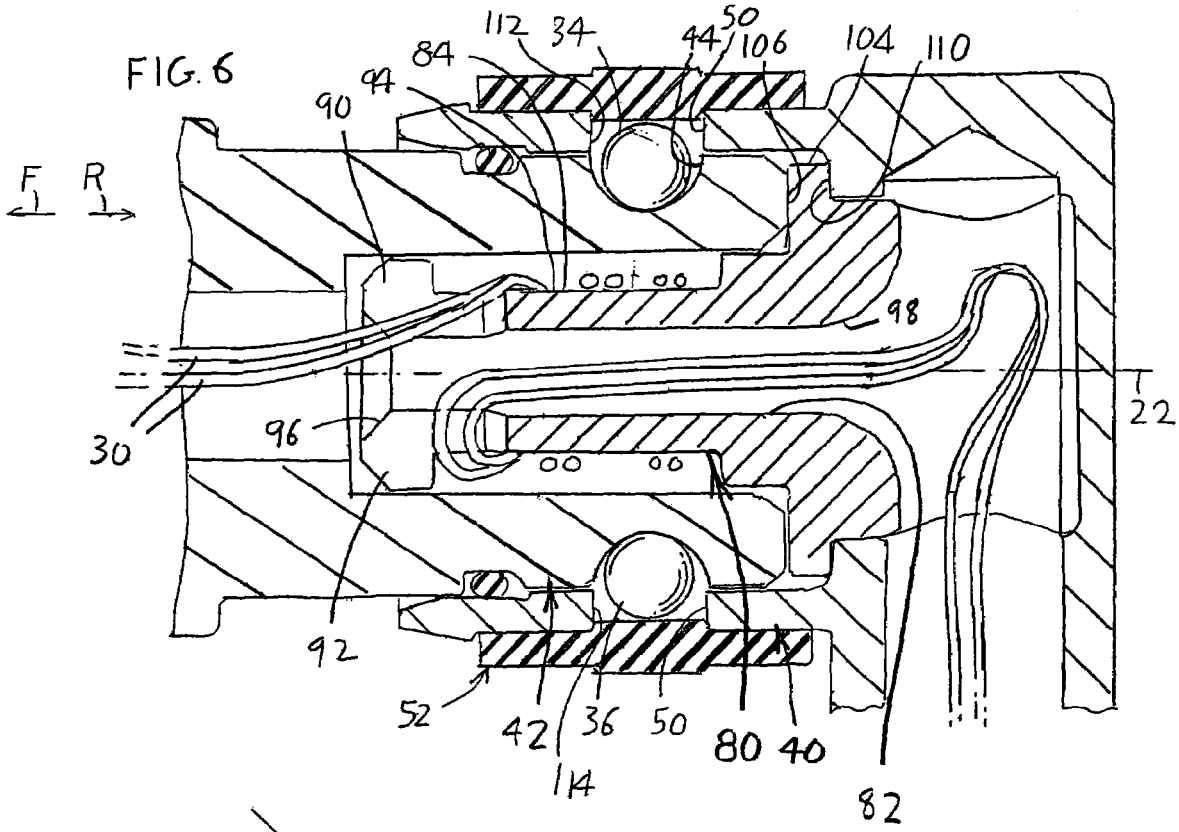
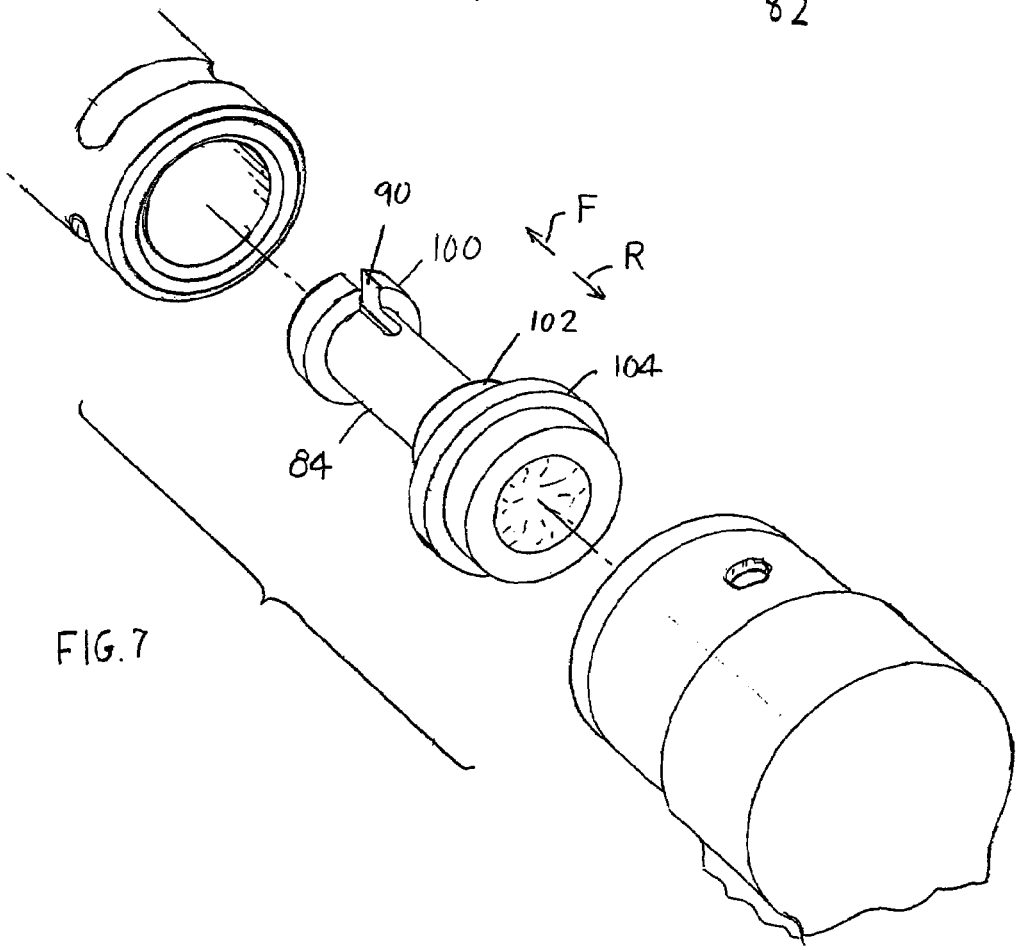
FIG. 7

PIVOTING STRAIN RELIEF WIRE GUIDE

BACKGROUND OF THE INVENTION

Electrical wires, such as individual wires or cables including coaxial cables, sometimes pass through a right angle guide in extending between pieces of electrical equipment. The right angle guide includes first and second tubes with main portions that extend at right angles to each other. Sometimes the route of the wire requires that the guide be capable of guiding a wire extending in any direction within a wide angle on either side of a center perpendicular direction. This can be accomplished by constructing the guide with a joint that allows the second tube main portion to pivot about the axis of the first tube. A simple pivot joint that enabled low friction pivoting and that gently limited the angle of such pivoting, would be of value.

The wires that extend through a guide to a piece of equipment such as a connector, often require provisions for strain relief. Strain relief assures that if the rear end of the wire is pulled, the front end of the wire that connects to the equipment will not be similarly pulled. Such pulling could damage or destroy solder or other connections of the wire end. Many strain relief devices are available, but it is desirable that such strain relief device be capable of being easily mounted in the narrow passage of a wire guide, especially a right angle guide.

SUMMARY OF THE INVENTION

In accordance with one embodiment of the invention, a wire guide is provided that guides a wire through a pair of tubes that have passages with axes extending at right angles, while allowing one tube to smoothly pivot about one of the axes with respect to the other, and while providing strain relief for the wire, in a compact guide. The passages are formed by a pair of tubes, including a first tube with front and rear ends and with a first passage extending along a first axis, and a second tube having a perpendicular main portion. The second tube has a backshell portion, or backshell, that extends along the first axis and that surrounds the rear end of the first tube. The rear end of the first tube has a pair of circumferentially-extending grooves that hold inner parts of balls, and the backshell portion has walls forming a hole that holds outer parts of the balls. The grooves extend no more than 180°, with groove ends forming stops that softly stop further rotation.

Strain relief is provided by a strain relief member that lies largely within the rear end of the first tube. The strain relief member has a through axial hole lying on the first axis, has at least one slot at one of its ends that leads to the outside of the strain relief member, and has a 360° wire-receiving groove on its outside. The wire extends partly through the axial hole, through the slot and around the groove perhaps a couple of times, and then extends back through a slot to the axial hole or first tube passage. The strain relief member has a rear flange that is captured between a rearwardly-facing rear end of the first tube and a forwardly-facing shoulder on the backshell. The balls hold the first and second tubes together with the strain relief member in place.

The novel features of the invention are set forth with particularity in the appended claims. The invention will be best understood from the following description when read in conjunction with the accompanying drawings.

BRIEF DESCRIPTION OF THE DRAWINGS

FIG. 1 is a front isometric view of a wire guide of the present invention.

FIG. 2 is a sectional view taken on line 2—2 of FIG. 1.

FIG. 3 is a sectional view taken on line 3—3 of FIG. 1.

FIG. 4 is a sectional view taken on line 4—4 of FIG. 3.

FIG. 5 is an enlarged sectional view of a portion of FIG. 3.

FIG. 6 is an enlarged sectional view of a portion of FIG. 2, with a wire shown installed on the strain relief member of the guide.

FIG. 7 is an exploded rear isometric view of the assembly of the first and second tubes and of the strain relief member of FIG. 6.

DESCRIPTION OF THE PREFERRED EMBODIMENTS

FIG. 1 illustrates a wire guide 10 of the invention which forms a conduit 12 comprising first and second tubes 14, 16. The first tube forms a passage 20 that extends along a first axis 22, and the second tube has a major portion 24 with a passage 25 that extends along a second axis 26. The second axis 26 is perpendicular to the first one 22. The guide is meant to guide a wire 30 along a right angle bend 32. By the term "wire" applicant is referring to one or more elongated elements that carry electrical power or signals, and includes simple wires that each includes a copper core and insulation around it, a cable with many of such wires held together, a coaxial cable, and other forms (including optical fibers).

Although the second axis 26 extends perpendicular to the first one 22, the second tube can pivot about the first axis 22 so the second axis extends in different directions such as at 22A and 22B while remaining perpendicular to the first axis. To provide for such pivotal connection, the second tube is provided with a backshell portion or backshell 40 that has an axis that is coincident with the first axis 22 and that surrounds the rear end portion, or rear end 42, of the first tube. FIG. 3 shows balls 34, 36 in grooves that pivotally support the backshell 40 of the second tube 16 on the first one. FIG. 6 shows that the first tube rear end 42 has grooves 44 that each receives a radially (with respect to axis 22) inner part of a ball 34, 36, and that the backshell portion has holes 50 that each receives a radially outer portion of the balls. A sleeve 52 surrounds the holes.

FIG. 4 shows that the first tube rear end 42 has an interrupted groove, or two ball grooves 44 that each has a ball-holding portion that subtends an angle A of about 100°. The radial depth of each groove is constant along the angle A. Two groove portions of a groove, each extends less than 180°. Two axially-spaced grooves each extends less than 360°. Each groove leads to stop portions at 60, 62 that form groove sections that are tapered in height to be of progressively smaller height along each opposite end 60, 62, to form a gentle stop at each end. The balls roll along each ball groove as the second tube backshell pivots, for smooth and low friction pivoting. When a ball reaches an end of the groove and starts to roll up one of its ends along a stop, the ball presses radially outward against the sleeve 52. Applicant prefers to use a sleeve 52 of elastomeric material (Young's Modulus of Elasticity of less than 50,000 psi) such as a moderately hard rubber to gently stop any further pivoting of the second tube and to prevent damage. It is possible to use one ball or more than two balls and ball grooves.

FIG. 3 indicates a wire 30 extending through the conduit formed by the two tubes, and having a front wire end 64 connected, as by soldering, to a contact 70 of a connector 72. It is usually desirable to provide strain relief so if the wire rear end 74 is pulled, the wire front end will not be pulled. This avoids the danger that a solder connection at the wire front end will be damaged. A large number of strain relief devices have been invented over the years, but applicant provides strain relief in a compact and simply installed manner in a compact wire guide 10.

FIG. 6 shows that the guide includes a strain relief member 80 that lies within both the first tube rear end 42 and the backshell 40. The strain relief member has a through passage or axial hole 82 that lies on the first axis 22, has a groove 84 on its radially outer surface, and has a pair of end slots 90, 92 that each extends into an end of the member and connects the front end of the hole to the groove. One or more wires 30 are mounted on the strain relief member by extending the wire through one end 96 of the strain relief member hole 82 and through a slot 90 or 92, and then wrapping the wire around the bottom surface 94 of the groove. The wire is then extended through the same or opposite slot back into the through hole and out an opposite end 98 of it.

As also shown in FIG. 7, the strain relief member has radially outward flanges 100, 102 at its opposite ends that leave the groove 84 between them. One or more of the flanges that form the groove can be formed on the first tube rear end. The slots 90, 92 extend through one of the flanges to the extreme front end of the member. As shown in FIG. 6, the strain relief member has a radially outward flange projection 104 at its rear end that lies between a rear end surface 106 of the first tube rear end 42 and a forwardly-facing shoulder 110 on the inside of the backshell portion. This allows simple mounting of the strain relief portion in the first tube passage.

The guide can be assembled by first wrapping the wires around the strain relief member 80 and extending front and rear portions of the wires through the first tube and through the backshell portion and the second tube. The first tube is moved rearwardly to receive the strain relief member in the first tube passage, and to allow the first tube to be received in the backshell portion. Balls are inserted through the ball holes in the backshell portion, and the sleeve 52 is slid rearward around the first tube and then around the backshell portion. The balls not only pivotally support the backshell on the first tube rear end, but prevent the backshell from moving rearward R off the tube rear end 42. Such rearward movement of the backshell would result in backshell shoulders 112, 114 in the ball-receiving holes pressing against the balls.

Thus, the invention provides a wire guide of a type that guides a wire through a right angle bend in extension through first and second tubes, and that allows the second tube to pivot a limited angle about the first tube axis, which provides low friction pivoting and gentle stops at opposite ends of the angle of pivoting and that provides a simple and simply installed strain relief member in the guide. One of the tubes has a portion that surrounds a portion of the other tube, and the tubes form at least one groove and a hole between them that hold a rolling element such as a ball (or roller) to pivotally connect the tubes in a low friction joint. Each groove has a circumferential end of progressively shallower depth. A sleeve that covers the ball-holding hole and that is preferably elastomeric, gently limits pivoting and avoids damage to the ball or groove. Strain relief is provided by a strain relief member with a through hole, a wrap groove at its periphery, and at least one slot that extends into an end of the member and that connects the hole to the groove. The balls hold the tubes together and hold the strain relief member between portions of the tubes.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A wire guide that includes a first tube having a first axis and a second tube having a second main axis extending perpendicular to the first tube axis, with the second tube being pivotal about said first axis relative to said first tube, wherein:

said first tube has a rear end portion and said second tube has a backshell portion with an axis that is coincident with said first axis and that is pivotally coupled to said first tube rear end portion, with one tube portion lying within the other, with a primary one of said tube portions having a groove that is curved about said first axis, and with a secondary one of said tube portions having a rolling element holder;

at least one rolling element having a first element part lying in said groove to roll along it and having a second element part confined in said element holder, with said holder limiting roll element movement in said holder;

said groove extends by a limited angle of less than 360° about said first axis and said primary tube portion forms stops at opposite ends of said groove that prevent roll element movement past part of the corresponding stop.

2. The wire guide described in claim 1 wherein:

said roll element is a ball, said track is a rounded groove of a cross-section large enough to receive part of said ball, and said stops are each formed by groove walls that form a groove of progressively smaller depth.

3. The wire guide described in claim 1 including:

a strain relief member which lies is said first tube, said member having a through hole lying on said first axis, an outer surface forming a circumferential groove, and at least one slot in said member that connects an end of said through hole to said groove.

4. The wire guide described in claim 3 including:

an electrical wire that extends through at least part of said first and second tubes and that extends completely through said through hole in said strain relief member;

said wire extending through a first end portion of said through hole, through said at least one slot and into said groove and at least once around said strain relief member in said groove, through said at least one slot, and through an opposite second end of said through hole.

5. The wire guide described in claim 3 wherein:

said groove is formed in said first tube rear end, said rolling element holder comprising a ball-receiving hole in said backshell, and said rolling element comprises a ball with a radially inner end lying in said groove and a radially outer end lying in said ball-receiving hole;

said strain relief member having a flange trapped between said first tube rear end and a shoulder on said backshell, and said backshell being prevented from moving rearwardly relative to said first tube, by said ball engaging a wall of said ball-receiving hole.

6. The wire guide described in claim 5 including:

a sleeve that extends around said backshell and that covers said ball-receiving hole.

7. The wire guide described in claim 6 wherein:

said sleeve is formed of elastomeric material.

8. A wire guide that includes a conduit through which wires can extend, said conduit having an axis, comprising:

a strain relief member which lies in said conduit, said member having a through hole lying on said axis, said member having an outside forming a circumferential groove, and said member having an end forming at least one through slot that leads from said hole to said groove; said wire extends through said conduit and through said hole in said strain relief member, and in extending through said hole in said strain relief member the wire extends through said at least one slot and into the groove, around the groove, and back through the at least one slot.

9. The wire guide described in claim 8 wherein:

said conduit includes first and second tubes that have first and second axes, respectively, said axes being perpendicular and said second tube having a secondary tube portion that extends along said first axis with said secondary tube portion and a portion of said first tube lying one inside the other and having cylindrical surfaces curved about said first axis and facing each other;

at least two balls, each lying partially in one of said grooves;

a secondary one of said cylindrical surfaces having at least two ball-holding holes that each receives one of said balls;

each groove having opposite ends forming a stop.

10. The wire guide described in claim 9 wherein:

said strain relief member lies in said first tube and said first tube forms said cylindrical surface that has said at least two grooves, said secondary portion of said second tube lies around said cylindrical surface and forms said at least two ball-holding holes.

11. A wire guide comprising:

a first tube having front and rear ends and forming a passage with a first axis;

a second tube having a second tube passage main portion that extends along a second axis that is perpendicular to said first axis, said second tube having a backshell portion that surrounds said first tube rear end and that is pivotal about said first axis about said first tube rear end;

said first tube rear end has a cylindrical outer surface with at least two circumferential ball grooves that each extends less than 180° about said first axis;

at least two balls, each having a portion lying in one of said ball grooves;

said backshell portion has at least two holes that each holds a portion of one of said balls.

12. The wire guide described in claim 11 including:

a strain relief member lying primarily within said first tube rear end and having a through hole lying on said first axis, said strain relief member having an outside forming a circumferential member groove extending 360° around said first axis, and said strain relief member having an end with a slot therein that connects said through hole to said member groove;

said strain relief member having a rear end forming a radially outwardly projecting flange that lies between a shoulders on said first tube rear end and a shoulder on said backshell.

13. The wire guide described in claim 11 wherein:

said at least two ball grooves each has opposite ends that each is of progressively lesser depth, and including;

a band that extends backshell portion and that covers said holes, said band being elastically expandable, to thereby gently stop backshell turning.

14. The wire guide described in claim 11 including:

a sleeve that is slidable to a position around said backshell portion to prevent loss of said balls.

* * * * *